US005316268A

United States Patent [19]

Mantey

[11] Patent Number: 5,316,268

[45] Date of Patent: May 31, 1994

[54] METHOD FOR INCREASING THE DURABILITY OF REFRACTORY VESSEL LININGS

[75] Inventor: Paul-Gerhard Mantey, Sulzbach-Rosenberg, Fed. Rep. of Germany

[73] Assignee: CRA Services Limited, Melbourne, Australia

[21] Appl. No.: 54,826

[22] Filed: Apr. 30, 1993

Related U.S. Application Data

[63] Continuation of Ser. No. 929,486, Aug. 8, 1993, abandoned, which is a continuation of Ser. No. 620,478, Nov. 30, 1990, abandoned.

[30] Foreign Application Priority Data

Dec. 8, 1989 [DE] Fed. Rep. of Germany ..... 3940575

[51] Int. Cl.[5] ..... C21B 7/04

[52] U.S. Cl. ..... 266/44; 266/283; 264/30; 52/596

[58] Field of Search ..... 266/44, 280, 283; 264/30; 52/596, 608

[56] References Cited

U.S. PATENT DOCUMENTS

| | | | |
|---|---|---|---|
| Re. 32,205 | 7/1986 | Kimmel | 266/283 |
| 3,350,085 | 10/1967 | Over | 266/283 |
| 3,463,865 | 8/1969 | Sarraf | 266/283 |
| 3,603,050 | 9/1971 | Coleman | 266/283 |
| 3,635,459 | 1/1972 | Mare | 266/283 |
| 3,695,604 | 10/1972 | Stein | 266/283 |
| 3,972,516 | 8/1976 | Napora | 266/283 |

OTHER PUBLICATIONS

Shamva, catalog No. 102, pp. 1-15 Jan. 2, 1958.

*Primary Examiner*—Scott Kastler

*Attorney, Agent, or Firm*—Nikaido, Marmelstein, Murray & Oram

[57] ABSTRACT

A method for increasing the durability of refractory linings in vessels having inclined areas or conical parts in their inside contour includes in fitting the refractory bricks obliquely following the inside contour of the vessel. The slant of the bricks is brought about step by step by several layers of machine-pressable turning bricks of known uniform density. This method makes it possible to obtain softer transitions from the horizontally laid bricks to the obliquely laid bricks.

12 Claims, 2 Drawing Sheets

METHOD FOR INCREASING THE DURABILITY OF REFRACTORY VESSEL LININGS

This application is a continuation of application Ser. No. 07/929,486 filed Aug. 8, 1993, now abandoned, which is a continuation of U.S. Ser. 07/620,478 filed Nov. 30, 1990, now abandoned.

The present invention relates to a method for increasing the durability of refractory vessel linings by obliquely fitting the refractory bricks.

In metallurgical materials processing, the vessels containing molten metal are furnished with a refractory lining to protect the steel constructions from high temperatures. These refractory linings comprising one or more layers of refractory bricks of equal or different qualities are located in the reactor vessels for the metallurgical processes themselves, as well as in the transport vessels and the after treatment aggregates. Steelmaking converters to be stated by way of example in this connection are ones using the various L.D. processes, open-hearth furnaces, pig iron and steel transport ladles, including the ladles for secondary metallurgy, and coal gas reactors and vessels for the various smelting reduction processes.

In view of the usually rotationally symmetrical vessel shape, the lining is installed in the form of rings of bricks having commercial formats that are wedge-shaped in one direction. These brick formats are chiefly so-called "transverse wedge bricks" or "full wedge bricks." The heights are equal, and in this way cylindrical vessels can be lined ring by ring with no trouble.

When the vessels are tapered or have oblique portions and the bricks are laid in rings as described above, steps occur in accordance with the angle of inclination, which cause an elevated degree of bricking wear as the step width increases. For example, brick heads can fall out of the bricking bond due to cracks parallel to the hot side of the refractory bricks.

This disadvantage in the lining of inclined or tapered wall areas has been recognized by the expert world, and suggestions have been made for avoiding or at least reducing the step width in the steps from ring to ring. For example, it is known to lay the bricks obliquely in conical wall areas, following the inclination of the wall. It is suitable to use for this purpose, among other things, bricks with holding means, usually metal clips of various designs. U.S. Pat. No. 3,274,742 describes such a system, and "Radex-Rundschau," No. 4, 1960, from p. 239, so-called "ferroclip bricks" for the suspension in curved wall areas of Siemens-Martin furnaces.

The literature "Transactions ISIJ," Vol. 26, 1986; B-361, describes the lining of a bottom corner of a converter with spherical wedge brick formats. Spherical wedge brick formats are not suitable for laying in rings. Spherical wedges also have angles of inclination clearly greater than 5°. They are not used for obliquely fitting commercial shaped bricks. The increased durability of refractory vessel linings obtained by the inventive method by obliquely fitting commercial shaped bricks is not obtained by the procedure described in this publication.

The lining of truncated wall constructions is described in detail in German laid-open applicator No. 26 07 598. This proposal consists in using wedge-shaped bricks whose angle of inclination is 5° to 30° that are disposed in on a slant with respect to the horizontal, and in having the adjacent side surfaces of the bricks extend vertically. The disclosure of this publication is expressly referred to.

This last-mentioned type of lining has become accepted in practice, in particular because in involves obliquely laying commercial wedge formats and disregarding the resulting open vertical joints or filling them with mortar. This lining technique is advantageous and inexpensive compared to fitting special formats, such as the above-mentioned bricks with holding clips or spherical wedge bricks.

In operating practice, however, disadvantages have also become apparent in the application of these known lining techniques, for example according to the proposal in German laid-open Applicators No. 26 07 598. The main one is that the shaped bricks, also known as "console bricks," used for bringing about the horizontal laying of the rings of bricks with the desired angle of inclination prove to be a weak point in the lining. With increasing use, premature areas of wear arise in the area of these console bricks. The known proposal of replacing the one ring of console bricks by up to five adapting layers of appropriately cut or preshaped bricks, each brick having a slope of at least 10°, also failed to provide a recognizable improvement in terms of the premature wear.

Not only the elevated wear of the console bricks proves to be disadvantageous, but also the abrupt changes of angle in the linear direction of the vessel lining when passing from the horizontal arrangement of bricks to the oblique one. It also proved to be difficult to adapt the layers of bricks to the contour of the vessel predetermined by the steel jacket using only one layer of shaped bricks.

The present invention is thus based on the problem of clearly improving, or wholly avoiding, the disadvantages of the known linings for inclined or conical walls, namely the premature wear of the refractory bricks in the transitional area from the horizontally laid bricks to the oblique ones, and furthermore of permitting a more favorable adaptation of the bricking to the vessel contour and softer transitions from the horizontally laid bricks to the oblique ones, thereby increasing the durability of the refractory vessel lining as a whole.

This problem is solved in the inventive method by bringing about the slant of the bricks step by step using several layers of machine-pressable turning bricks of known, uniform density.

The object of the invention is thus a method for increasing the durability of refractory vessel linings by obliquely fitting commercial shaped bricks usually used for laying in rings, or rectangular bricks, characterized in that the slant of the bricks is brought about step by step with angles of inclination smaller than 5° using several layers of machine-pressable turning bricks having a uniform density comparable to that of commercial formats.

The object of the invention also includes turning bricks with commercial machine-pressable basic formats that are fitted to bring about a slant of the bricks in accordance with the method for increasing the durability of refractory vessel linings, characterized in that the angle of inclination of one brick surface of the turning brick, relative to the opposite brick surface, is 0.5° to 5°, preferably 2° to 3°.

The inventive method is suitable for the refractory lining of any kind of reaction vessel for molten metals, in particular molten iron, in particular steelmaking converters, open-hearth furnaces, transport ladles, coal gas reactors and vessels for smelting reduction processes.

Surprisingly enough, the oblique fitting of refractory bricks in metallurgical vessels by the inventive method has led to clear improvements in durability going far beyond the expected extent. The initial intention was to fit the bricks obliquely in oblique wall areas, for example the tapered upper converter area, the so-called "converter hood," to reduce the step width of the stepped rings of bricks, thereby preventing spalling and avoiding places of premature wear. However, it turned out that the oblique fitting of the bricks led to unexpectedly low rates of wear. While the horizontal fitting of rings of bricks involves average rates of wear, disregarding the places of premature wear, of approx. 1.8 mm per batch, these values drop by 28% to 1.3 mm per batch when the rings of bricks are inclined at 19°.

One possible explanation for this high increase in durability when using the inventive method is that the direction of stress of the oblique bricks, regarded from their hot side, is more favorable with respect to the pressing direction of the bricks. This surprising result is confirmed when bricks are obliquely fitted according to the inventive method in the bath zone of a metallurgical vessel, for example in the lower cone of a converter for steelmaking. Here, too, the durability of the refractory lining was increased by approx. 25%.

A further essential feature of the present invention is to bring about the slant of the lining with commercial bricks step by step, preferably with small changes of angle, in each layer of turning bricks. It has proved to be particularly advantageous to keep the changes of angle for each layer of turning bricks smaller than 5°. For example, a slant of altogether 20° can be produced for a lining of commercial bricks using six to ten layers of turning bricks.

The oblique fitting of commercial bricks is usually between 25° and 40° and in particular between 5° and 25° with respect to the horizontal. The commercial bricks are usually transverse wedge bricks, half wedge bricks and full wedge bricks, as well as rectangular bricks.

This step-by-step formation of the total slant of obliquely fitted commercial bricks according to the invention results in surprising advantages and clear increases in durability in otherwise critical and often prematurely wearing areas of the lining. While the known method of obtaining an inclined fitting position of the bricks using one or a few rings of shaped bricks necessarily involved abrupt changes of angle in the refractory lining, the inventive method makes it possible to create softer transitions. For example, the slant from 0° to 20° is distributed over eight layers of turning bricks and thus over a lining height of approx. 800 mm. By contrast, this change of angle is effected in the known type of lining from layer to layer, i.e. the horizontal arrangement of bricks passes directly into the inclined laying of bricks. This spontaneous change of angle in the arrangement of bricks leads to accordingly hard transitions in the inside contour of the vessel lining. However, since premature refractory wear is observed in these transitional zones in the linings of metallurgical vessels in which highly turbulent bath currents and high waste gas flow rates occur, it is assumed that unfavorable flow patterns, for example whirls, result in these places and cause this premature wear in the refractory materials. This disadvantage of the known lining technique is overcome by the method according to the invention. By distributing the change of angle over many-up to twenty-layers of bricks, one obtains soft transitional zones in the inside contours of the lining that probably have a favorable effect on the flow conditions in the metallurgical vessel and thus contribute to a clear improvement in the durability of the lining in these critical vessel zones.

Surprisingly enough, the inventive method has also completely avoided the premature wear, occasionally showing in the form of holes, that is frequently observed on the known rings of shaped or console bricks. As subsequent, more precise tests on console bricks have demonstrated, these sometimes hand-rammed brick formats show poorer technological values in comparison with customary machine-pressed brick formats. On the one hand, the measured absolute values of bulk density and cold compression strength are lower for the console bricks and, on the other hand, these data vary across the cross section of the brick. The narrow side of the brick, i.e. the tip of the wedge, often shows higher measured values in comparison with the values on the wide side of the brick, i.e. the base of the wedge. It is assumed that these different technological properties effect the locally occurring premature wear of these wedge or console bricks.

By contrast, the inventive method allows the use of turning bricks with a small angle of inclination of less than 5°, preferably 1° to 4° and in particular 2° to 3°, so that it is possible to produce these turning bricks on the known block machines like the customary brick formats. Even the necessary changes in the press molds are little trouble for the small angles of inclination and can be performed at low cost.

Tests on these machine-pressed turning bricks have shown, in comparison with the corresponding commercial formats, the same technological data with the known dispersion over the total cross section of the brick. This is probably the reason why discrete premature areas of wear no longer occur at all when these turning bricks are used in vessel linings.

The differences in density are less than ±10% from the means, preferably less than ±5% and in particular less than ±3%.

According to the method of the invention, the slant for fitting commercial formats can be brought about by a corresponding number of layers of turning bricks, for example two to 25 layers, depending on the desired total slant. However, one can also, without disadvantage, provide one or more layers of commercial bricks, e.g. transverse wedge bricks, between the layers of turning bricks when laying the rings. This combination of layers of turning bricks and commercial formats allows a particularly slow transition from the horizontally laid bricks, for example, to the obliquely fitted layers. Finally, this inventive combination of layers of turning bricks and layers of commercial bricks also allows for selective changes in the slant when laying the bricks. For example, two layers of turning bricks can result in a slant of 5° for fitting any desired number of layers of commercial bricks, and this slant can then be increased by further layers of turning bricks.

It is of course within the scope of the invention to remove the slant of the fitted commercial bricks step by step again using turning bricks having an opposed angle of inclination which is likewise smaller than 5°. The oblique fitting of refractory bricks can of course also be removed using layers of commercial formats between the layers of turning bricks.

According to the inventive method by which the slant of the bricks is brought about step by step by several layers of machine-pressable turning bricks, one can control within certain limits the adaptation of the lining to the vessel contours predetermined by the sheet steel casing. Gradual transitions from one slant to another or, as more often employed, from the horizontal fitting position to a slant have proved to improve the durability of the refractory material in comparison with abrupt changes of angle in the laid bricks. For example, the pattern of wear of the lining in the transitional area from the lower cone to the cylindrical wall portion was improved very advantageously in a converter. In the known lining with horizontal parallelogrammatic rings of bricks in the lower cone and customary rings of transverse wedge bricks in the cylinder, the change of angle of approx. 30° from the conical portion to the cylindrical portion was abrupt. The typical pattern of wear shown in this converter lining was a premature wear of bricks in this transitional area, that looked as if the cylindrical vessel area were extended into the lower cone, and the greatest wear of bricks about six to ten layerand the below the first layer of cylinder bricks, which then caused the vessel to be put out of action. By fitting eight layers of turning bricks, commencing with the bottom level of the converter, thereby obtaining a 20° slant for laying commercial transverse wedge bricks in the lower cone, and then gradually removing this slant by eight layers of turning bricks with a reverse angle of inclination to arrive at the horizontal fitting of the cylinder bricking, it was possible to cause a drastic change in the previously typical pattern of wear. The lining by the inventive method now showed a uniform wear in this previously critical transitional area, which finally resulted in an increase in the durability of the total lining of approx. 25%.

When lining an iron bath reactor for carrying out tests on smelting reduction, the method according to the invention has proved to be particularly flexible and adaptable when changes are made in the inside contour of the lining without regard for the outer shape of the vessel. Desired changes in the inside shape of a horizontal cylindrical converter vessel were obtained by corresponding changes in the lining. For example, the oblique fitting of layers of bricks by the inventive method permitted tapering in this cylindrical vessel, for example to reduce the area for the molten iron in the converter. These changes in the inside contour of the vessel were performed in an advantageous way by bringing about the desired slant of commercial bricks step by step using several layers of turning bricks.

The turning brick for carrying out the inventive method should only exhibit angles of inclination of one brick surface, relative to the opposite brick surface, of 0.5° to no more than 5°. The preferred angle of inclination is in the range of 1° to 4° and in particular 2° to 3°. As already reported, these small angles of inclination allow the turning bricks to be produced on the known presses. One thus obtains very uniform technological values across the total cross section of the brick. In this respect the turning bricks have chemical and technological production data equivalent to those of commercial brick formats. For a typical turning brick to be laid in rings, i.e. a transverse wedge brick in the basic format, the differential measure between the narrow and wide sides of the brick is about 25 mm with an angle of inclination of about 2.8° and a brick length of 500 mm. With an angle of inclination of approx. 2.5° and a brick length of 900 mm, this differential measure is 40 mm.

When carrying out the inventive method it is basically irrelevant whether one obtains the angle of inclination by adding this differential measure to the height of the turning brick basic format or by subtracting it. For example, the brick height in converter transverse wedge formats is preferably 100 mm, and with a brick length of 500 mm the differential measure of 25 mm can lead to a one-sided increase in the brick height of 125 mm or to a reduction to 75 mm. In practice, turning bricks with heights of 100 mm in the center of the brick have proved to be particularly expedient. When producing these turning bricks one takes half the total differential measure into consideration on each opposite side of the brick. In the rings of turning bricks with a height of 100 mm in the center of the brick, it is possible without disadvantage to change the angle of inclination of the turning bricks within a ring, or to combine commercial formats with turning bricks within the ring. It is within the scope of the invention to bring about oblique brick positions in certain areas of a ring of bricks in this way. For example, one can thus provide favorable conditions in the lining for fitting tuyères that penetrate the lining.

An oblique fitting of customary wedge-shaped brick formats means that the joints between the bricks of a layer open in a wedge shape. For example, the vertical joints between the individual bricks of a horizontally disposed, closed ring of many transverse wedge formats open in a wedge shape when it is laid on a slant. The base width of this wedge-shaped joint is, for example, 3 mm when a transverse wedge brick with the customary height of 100 mm is slanted at 20°. Surprisingly enough, these joints opening on one side have not led to any difficulties in practice. No disadvantages were caused by these joints in the linings of various aggregates either when the bricks were laid with customary mortars or dry joint fillers, for example fine-grained dolomite or magnesite, or when they were laid without any joint filler. It is thus within the scope of the invention to fit commercial brick formats obliquely without taking any special measures beyond the customary known laying techniques with and without joint filler.

The application of the method according to the invention is of course independent of the quality of brick used. All known qualities of brick with any desired chemical composition, bond and density can be used for the inventive method. For example, one can use fireclay bricks or bricks of higher refractoriness, such as sillimanite or mullite, or corundum bricks of various qualities. It is particularly advantageous to fit qualities of brick with greater thermal expansion, such as dolomite and/or magnesite bricks of various quality levels with a ceramic, pitch or resin bond, by the inventive method. Dolomite bricks and mainly magnesite bricks, also with different carbon enrichments up to 22% residual carbon content, can be laid successfully in converters for steelmaking, for example, by the method according to the invention.

The inventive method has proved to be particularly advantageous for lining the reaction vessels for smelting reduction and coal gasification. One can use, along with the stated qualities of brick, ceramic bound magnesite-chromium bricks of various sintering qualities, fusion cast refractory building materials and picrochromite bricks. Metal-cased bricks have also proven to be suitable.

The method according to the present invention has made it possible to achieve a surprising increase in the durability of refractory vessel linings by obliquely fitting the refractory bricks. The slant of the bricks is brought about step by step using turning bricks that can be produced with no trouble on customary block machines due to their small angle of inclination of less than 5°. The inventive method also avoids local places of premature wear in the layers of turning bricks, and the gradual, step-by-step formation of the oblique brick position now results in softer transitions with increased durability in the critical transitional zones of the known lining technique. A further advantage of the inventive method is the increased flexibility in adapting vessel linings to the predetermined sheet steel contour and also in adjusting inside contours of a vessel independently of the sheet steel casing.

BRIEF DESCRIPTION OF THE DRAWINGS

The invention shall now be explained with reference to nonrestrictive examples and figures.

Figure 1:
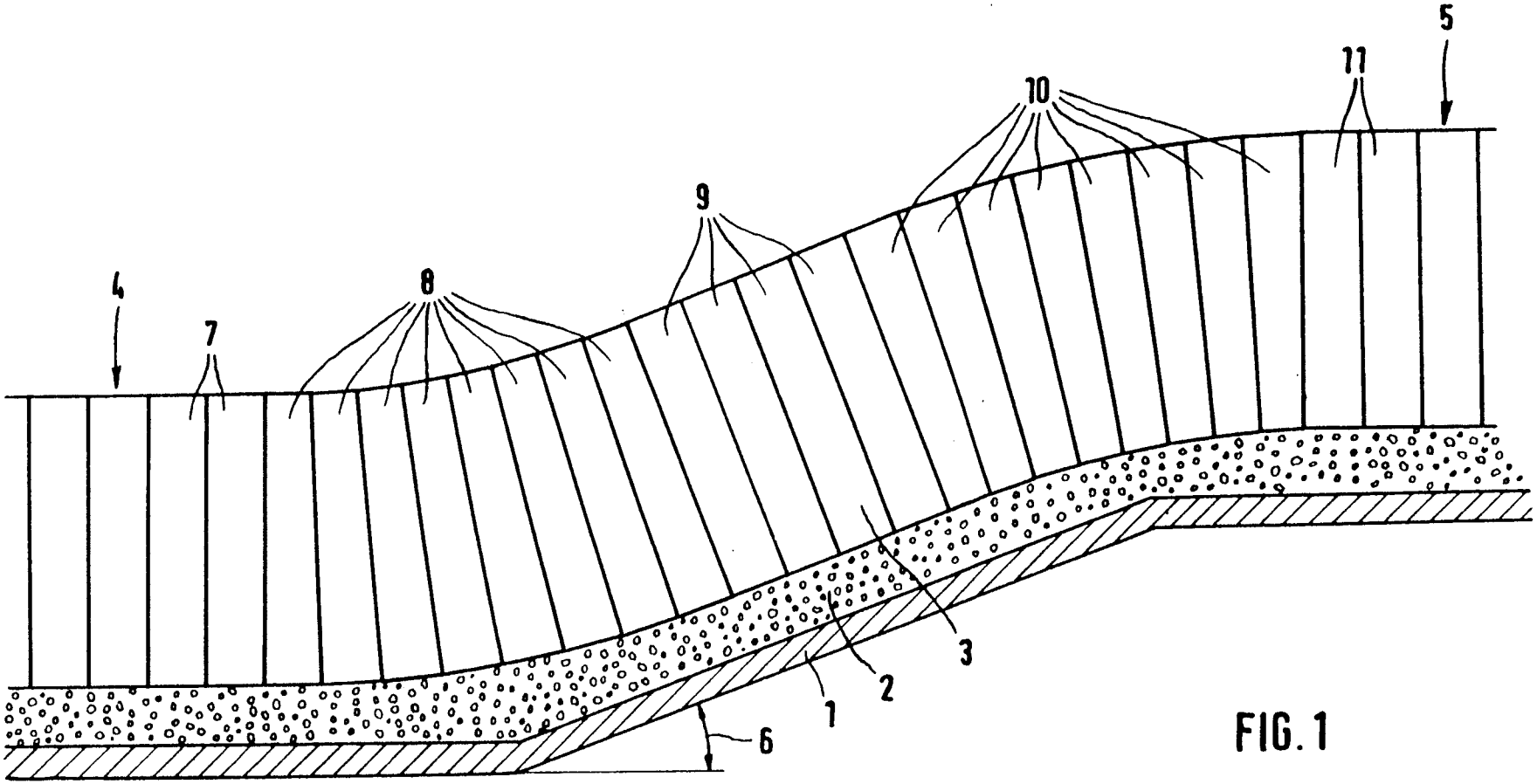
FIG. 1 shows the section through a vessel area lined according to the teachings of the inventive method.

The section in FIG. 1 through one half of part of a rotationally symmetrical drum type reactor shows sheet steel 1 and the two-layer structure of the refractory lining. It comprises insulating layer 2 and wearing layer 3. The semilaterally shown vessel portion comprises a cylindrical portion with large inside diameter 4 of 3 m and the second cylindrical area with smaller inside diameter 5 of 2.2 m. These two cylindrical vessel areas are connected by a conical transition piece with an angle of inclination 6 of 20°.

Wearing bricks 7 in the larger cylindrical part are transverse wedges with a brick length of 500 mm, mixed from the formats 50/36 and 50/60 for each ring-shaped layer. They are followed by eight layers of turning bricks 8, which also have the basic format of transverse wedges but exhibit a second wedginess of approx. 3° in the axial direction of the vessel. These are followed by four layers of customary transverse wedges 9. These transverse wedges correspond precisely to formats 7, but a different mixture ratio per ring is used due to the decreasing diameter. Then come another eight layers of turning bricks 10 whose wedginess in the axial direction of the vessel is likewise 3° but in the reverse direction to turning bricks 8. The wall of the smaller cylindrical part is then lined with transverse wedges 11 of the same types as transverse wedges 7, but in an adapted mixture ratio.

As can be seen in FIG. 1, the lining follows the vessel contour in a well adapted, soft line. There are no steps from ring to ring in the conical area of the wall, as are otherwise customary.

Figure 2:
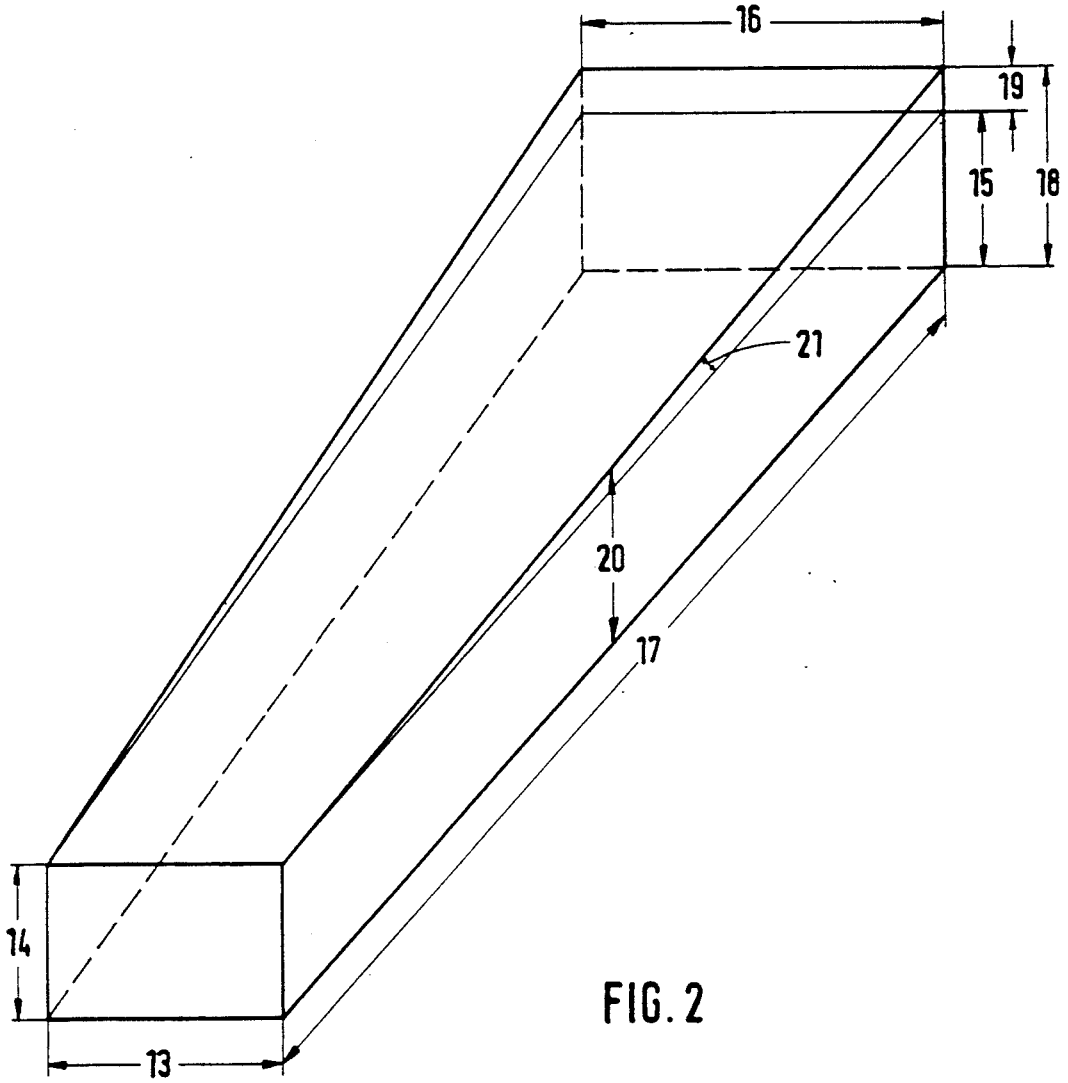
FIG. 2 shows a turning brick.

FIG. 2 shows by way of example a turning brick that starts out from a basic transverse wedge format, for example a converter brick with the customary format designation 50/36. The dimensions for the basic transverse wedge format corresponding to the marking numbers in FIG. 2 are 13=132 mm, 14 and 15=100 mm each, 16=168 mm and length 17=500 mm. Dimensions 13, 14, 16 and 17 remain the same for the turning brick in the shown case. Dimension 15 increases by 26 mm according to 19, resulting in a height 18 of 126 mm. This results in an angle of inclination 21 of 3°.

Laying such a turning brick in rings one thus obtains a slant of 3° per ring.

In the turning brick shown in FIG. 2, wedge-shaped portion 19 is added to the original transverse wedge height 14 and 15. The same goal is of course also reached by reducing height 14 or 15 by amount 19.

A particularly advantageous design within the scope of the invention is to retain original brick height 14 or 15 in center 20 of the brick and to distribute total wedge amount 19 over heights 14 and 15 in equal shares. For the transverse wedge format shown, this means reducing height 14 by 13 mm and increasing height 15 by 13 mm. Bricks with this advantageous dimensioning make is possible to combine turning bricks with commercial transverse wedges in a closed ring, thereby laying only parts of a ring on a slant.

I claim:

1. A generally rotationally symmetrical, refractory lined vessel suitable for containing molten metals, said vessel having a generally vertical wall section and an inclined or tapered wall section having an area of change of curvature from the vertical wall section, the refractory lining of the vertical wall section comprising at least one ring of refractory bricks, the refractory lining at the area of change of curvature being at least two rings of turning bricks, each turning brick having six surfaces comprising first planar surface defining a plane, four planar side surfaces extending in a perpendicular direction from said plane, and a second planar surface located on said brick opposite said first surface, said second surface being inclined from said plane of an angle of less than 5°.

2. A method of increasing the durability of refractory vessel linings in metallurgical materials processing vessels having inclined or tapered wall areas comprising installing at least one layer of refractory bricks, said bricks having a substantially uniform height from one end face to an opposite end face, on an inner, generally vertical wall surface of the vessel to provide an inner refractory surface; and installing at least two layers of refractory turning bricks above the at least one layer to provide a soft transitional zone of the lining in the area of the vessel having an inclined or tapered wall area, wherein the refractory turning bricks have six surfaces comprising a first surface defining a plane, four side surfaces extending in a perpendicular direction from said plane, and a second surface located on said brick opposite said first surface, said second surface being inclined from said plane of an angle of less than 5°.

3. A method of increasing the durability of refractory vessel linings in metallurgical materials processing vessels having inclined or tapered wall areas representing changes of curvature of the vessel, comprising installing at least one ring of refractory said bricks having a substantially uniform height from one end face to an opposite end face, on an inner, generally vertical wall surface of the vessel to provide an inner refractory surface having a first curvature; and gradually changing the curvature of the refractory surface by installing at least two rings of refractory turning bricks above the at least one ring in the area of curvature change to provide a soft transitional zone of the lining in the area of the vessel having curvature change, wherein the refractory turning bricks have six surfaces comprising a trapezoidal-shaped first surface defining a plane, four side surfaces extending in a perpendicular direction from said plane, and a second surface located on said brick opposite said first surface, said second surface being inclined from said plane at an angle of less than 5°.

4. The method of claim 3, wherein at least one ring of trapezoidal bricks having a substantially uniform height from one end face to an opposite end face is fitted between at least two rings of said refractory turning bricks.

5. The method of claim 3, wherein the refractory vessel has an outer steel casing and the gradual change of the curvature of the refractory surface produces an inner refractory surface having a contour which approximates that of the steel casing.

6. Method of claim 3, wherein the turning bricks have differences in density which are within 10%, plus or minus, from the mean.

7. Method of claim 3, wherein the second surface of the turning bricks is inclined from said plane at an angle of about 2° to 3°.

8. A refractory turning brick having six surfaces comprising a first surface defining a plane, four side surfaces extending in a perpendicular direction from said plane, and a second surface located on said brick opposite said first surface, the first and second surfaces being of greater surface area than any one of the side surface areas, said second surface being inclined from said plane of an angle of less than 5°.

9. Brick of claim 8, wherein said first surface is a trapizoidal-shaped surface.

10. Brick of claim 8, wherein the angle is from about 2° to about 3°.

11. Brick of claim 9, wherein the brick is of substantially uniform density.

12. Method of claim 3, wherein the vessel curvature change in said transitional zone is between 5° and 40°.

* * * * *

UNITED STATES PATENT AND TRADEMARK OFFICE

CERTIFICATE OF CORRECTION

PATENT NO. : 5,316,268

DATED : May 31, 1994

INVENTOR(S) : Paul-Gerhard MANTEY

It is certified that error appears in the above-identified patent and that said Letters Patent is hereby corrected as shown below:

On the title page, Item [63], first line, change "Aug. 8, 1993" to -- Aug. 18, 1992 --.

Signed and Sealed this

Third Day of January, 1995

*Attest:*

Bruce Lehman

BRUCE LEHMAN

*Attesting Officer*

*Commissioner of Patents and Trademarks*